United States Patent [19]

Persson

[11] 3,934,828

[45] Jan. 27, 1976

[54] WEAR-RESISTANT WALL LININGS FOR SHELLS OF MILLS AND LIKE APPARATUSES

[75] Inventor: Bo Klas Gerhard Persson, Hollviksnas, Sweden

[73] Assignee: Trelleborgs Gummifabriks Aktiebolag, Trelleborg, Sweden

[22] Filed: May 17, 1974

[21] Appl. No.: 471,108

[30] Foreign Application Priority Data

May 18, 1973 Sweden ..... 73070443

[52] U.S. Cl. ..... 241/102; 241/182; 241/300; 241/DIG. 30

[51] Int. Cl.[2] ..... B02C 17/22

[58] Field of Search ..... 241/65, 66, 67, 102, 182, 241/183, 286, 290, 293, 294, 298, 299, 300, DIG. 30; 51/164

[56] References Cited

UNITED STATES PATENTS

| | | | |
|---|---|---|---|
| 2,589,603 | 3/1952 | Cohen | 241/102 |
| 2,909,335 | 10/1959 | Janelid | 241/DIG. 30 |
| 3,009,659 | 11/1961 | Jones | 241/102 |
| 3,194,506 | 7/1965 | Bourne et al. | 241/300 |

*Primary Examiner*—Granville Y. Custer, Jr.
*Attorney, Agent, or Firm*—Browne, Beveridge, DeGrandi & Kline

[57] ABSTRACT

A wall of elastomeric material having at least one inner cavity for a pressure fluid. The wall is compression prestressed in the portion thereof closest to the surface which is subjected to wear in the use of the wall.

2 Claims, 10 Drawing Figures

WEAR-RESISTANT WALL LININGS FOR SHELLS OF MILLS AND LIKE APPARATUSES

A great many different types of fastenings have been suggested for wear-resistant linings of rotary elongated drums or other types of wear-resistant liners, as will be evidenced by a long series of patents within the technical fields concerned. By way of example, mention may be made of Swedish Pat. No. 227,759 and U.S. Pat. No. 3,194,506. In the former patent the wear-resistant lining has been clamped to the shell of the mill drum, and in the latter patent the wear-resistant lining proper has been clamped in the form of loose longitudinal bars to a subjacent rubber material. Moreover, in Swedish Pat. No. 159,488 there has been suggested to anchor the wear-resistant rubber material by shaping said material as a ring which is pressed by its inherent elasticity against the inner side of a mill shell.

It has been found that all of the above-mentioned fastening methods and also other prior art fastening methods suffer from drawbacks since material can find its way between the shell and the lining in spite of every precaution taken. It has proved difficult to compression stress the surface layer facing the interior of the mill drum and thus to promote the abrasion resistance of the wear-resistant rubber lining.

The object of the present invention is to eliminate the drawbacks inherent in the prior art types of wear-resistant wall linings, for example in mill drums, and to provide compression prestressing of the surface layer that is exposed to the action of wearing material. This object is realized according to the invention by forming a wall exposed to wear, preferably of reinforced elastomeric material. The wall is inflatable by means of liquid or gas and has one or more inner cavities for receiving the liquid or gas. The inflated wall is compression prestressed in that surface portion thereof which is exposed to wear.

The invention will be more fully described hereinbelow and with reference to the accompanying drawings in which.

Figure 1:
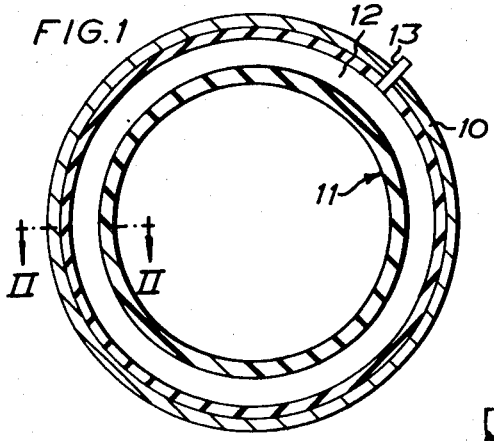
FIG. 1 is a cross-section of a mill drum having a wear-resistant lining formed in accordance with the present invention.
Figure 2:
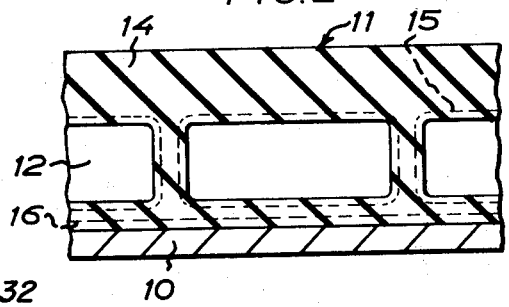
FIG. 2 is a section on the line II—II in FIG. 1.

A mill shell 10 of circular cross-section and of suitable metallic material is illustrated in FIG. 1. On the inner side of said shell there is mounted a wear-resistant lining 11 in the form of an inflatable wall which has inner channels 12 connected by one or more inlet stems 13 to a pressure source. When the lining is placed under pressure by means of liquid or gas supplied to the channels 12, the lining will be firmly pressed against the shell 10 and try to expand inwardly towards the center of the mill drum, whereby the elastomeric layer 14 closest to the interior of the mill drum will be compression prestressed, which is very advantageous with regard to the abrasion resistance of the elastomeric material.

The inner channels 12 in the wear-resistant lining 11 can be reinforced by means of fabric or cord, the reinforcement 15 extending all around the channels in order to permit a higher pressure in them. Moreover, a fabric or cord reinforcement 16 can be provided between the channels 12 and the surface of the wear-resistant lining bearing against the shell 10, to increase dimensional stability.

The shell 10 in FIG. 1 need not be continuous but may have recesses which reduce its weight and cost. This is an important advantage.

Figure 3:
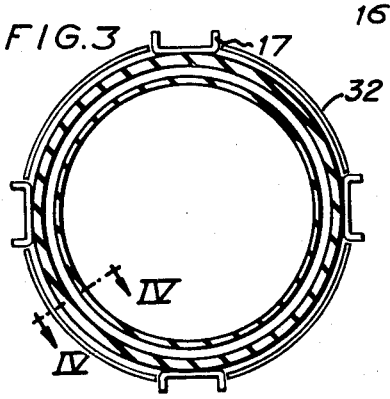
FIG. 3 is a cross-section of another mill drum which has been equipped with a wear-resistant lining according to the present invention.
Figure 4:
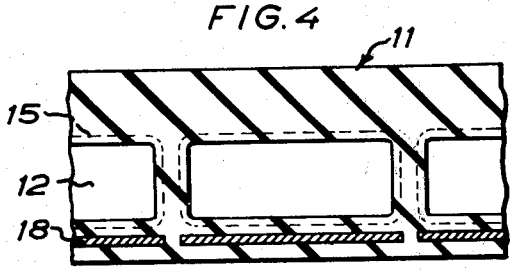
FIG. 4 is a section on the line IV—IV in FIG. 3.

FIG. 3 illustrates another embodiment of the invention, in which the wear-resistant wall or the actual lining forms both the lining and the shell of the mill, the wall being supported by a suitable number of supporting beams 17 which are mounted on a supporting structure 32 to permit rotation of the mill drum. As will appear from FIG. 4, this mill wall also has inner channels 12 which preferably have reinforcements 15 which extend all the way round. Here, inextensible reinforcements 18, which may be metal rings or other suitable inextensible material are arranged between the cavities 12 and the outer side of the wall of the mill. In this case also the expansion of the mill drum radially outwardly is prevented by the presence of inner inextensible reinforcement 18 in the wall proper. The elastomeric material on the inner side of the mill drum will also in this case be placed under compression prestress.

Figure 5:
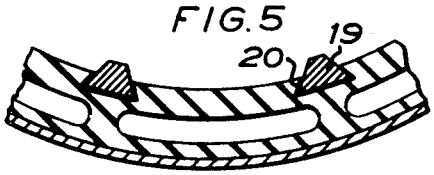
FIGS. 5, 6 and 7 show alternative wear-resistant wall linings according to the present invention.

FIG. 5 illustrates an alternative embodiment in which the pressure forces in the elastomeric material on the inner side of the wear-resistant lining are exploited for the retention of lifters 19 arranged in recesses 20 in the wear-resistant wall lining.

Figure 6:
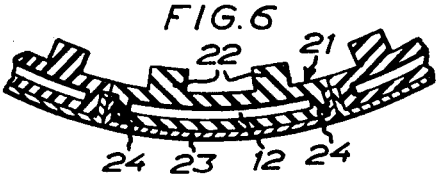

FIG. 6 illustrates an embodiment in which the wear-resistant wall or lining is composed of segments 21 which present one or more inner cavities 12 and on their side facing the interior of the mill have lifters 22 integral with said segments 21. In this case, the segments 21 are inserted in shell elements 23 which are of a shape similar to U-beams and which by their flanges 24 provide the requisite counter-pressure to permit compression prestressing that surface of the segment 21 which is exposed to wear.

Figure 7:
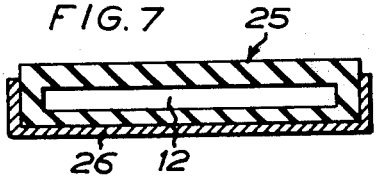

FIG. 7 illustrates a planar wall portion 25 having an inner inflatable cavity 12. Said planar wall portion 25 is arranged in a holder 26 having the shape of a cup or U-beam, and it can be exploited for use for instance in the end walls of mill drums.

Figure 8:
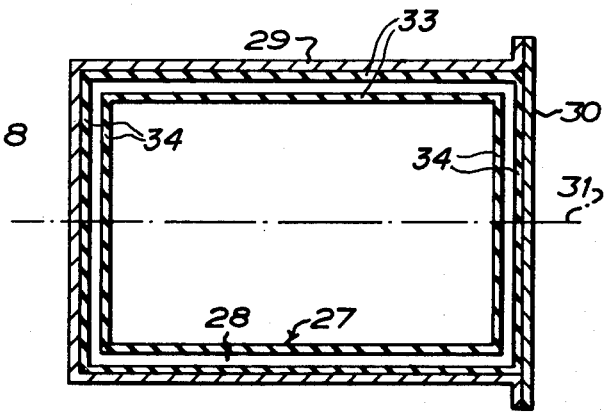
FIGS. 8, 9 and 10 show different methods of locating and designing wear-resistant wall linings in mill drums with the use of the present invention.

FIG. 8 diagrammatically illustrates a lining in the form of a bag-like structure 27 the wall of which has inner inflatable channels 28. Said bag-like structure 27 has a sidewall portion 33 and end wall portions 34. It is mounted in a bucket-shaped mill drum 29 the free open end of which is closed by means of a cover 30. The mill drum in FIG. 8 can be mounted for rotation about its axis 31, but it may also be rotated about an axis extending at some suitable angle to said axis 31. The interior of the mill is accessible through inlet openings (not shown) which can be closed in some suitable way.

Figure 9:
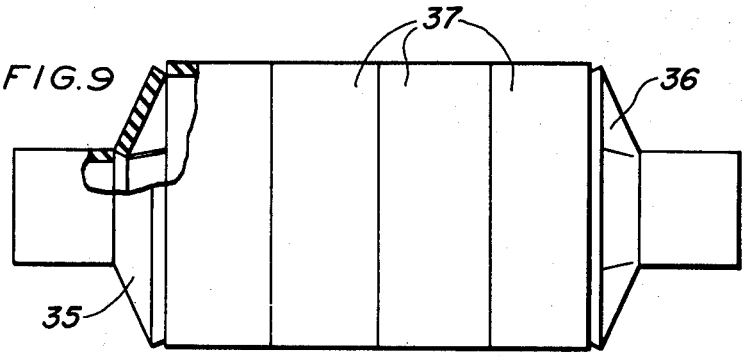
Figure 10:
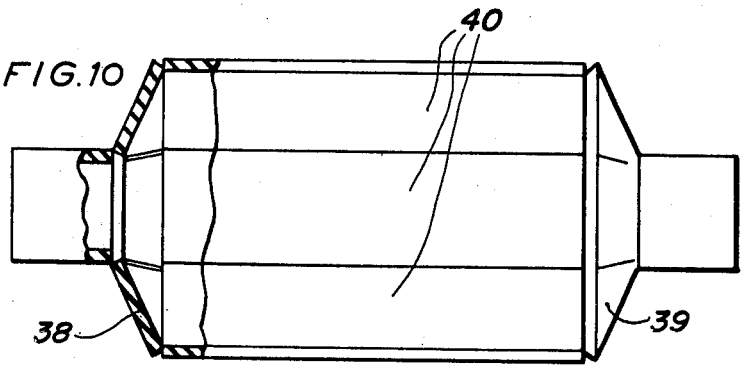

FIGS. 9 and 10 show two different possibilities of dividing the wear-resistant lining according to the invention into segments when said lining is used in conventional shells of mill drums. For greater clarity the shell plates have been omitted from these drawings. In FIG. 9, there are end segments 35 and 36, and circumferential segments 37. The embodiment of FIG. 10 is provided with end segments 38 and 39 similar to those of FIG. 9, and axially-extending central segments 40. In these two embodiments it must, of course, be seen to it that each wall section has a pressure fluid inlet of its own.

If a wear-resistant wall lining is designed in accordance with the present invention, i.e., formed as an inflatable structure in which the material of the wear-resistant surface is compression prestressed there will be obtained a lining of very high resistance to wear on the one hand, because the material is exposed to the compression prestress and, on the other hand, because the material is resiliently supported. The inflatable elements will have the requisite counterhold from the surrounding supporting structures or the inextensible means inserted in the elements. The inflatable elements can be formed as loose elements with regard to the surrounding supporting structures but may also be fixedly anchored thereto, for instance by gluing or vulcanization.

With the wall elements formed as loose elements with regard to the supporting structure, for instance in an ore mill which is designed for the prevailing types of mill linings, a connection will be formed between the elements and the mill shell by the inflation of said elements and their resulting application against the mill shell. The outer side of the wall elements may have recesses which receive corresponding pins on the inner side of the mill shell so that a still better anchorage of the inflatable wall is attained.

When use is made of the inflatable wall as a means for the retention of loose lifters 19 or like means, the loose lifters may be made of the same material as the wall, that is an elastomer such as natural or synthetic rubber, or these loose lifters may be formed of such materials as cemented carbide, steel or stone.

Another advantage associated with the wall according to the present invention is that, by causing the pressure medium, that is some suitable gas or liquid to circulate under pressure in the channels of the wall, it is possible to cool or heat said wall in conformity with the contemplated uses of said wall.

What I claim and desire to secure by letters patent is:

1. A wall which is subjected in use to wear and which is made of wall segments, each of said wall segments including a wall element made of an elastomeric material, each of said wall elements having at least one inner cavity containing pressure fluid, each of said wall segments having a cup-shaped supporting element secured to a said wall element and having edges of which are upstanding along the sides of the wall element to support said sides of the wall element upon inflation of the wall element, said wall being compression prestressed in the portion thereof closest to the surface subjected to wear.

2. A wall which is subjected in use to wear, said wall being formed of wall elements and supporting elements, each of said wall elements being formed of elastomeric material and having at least one inner cavity containing pressure fluid, each of said supporting elements being in the shape of a U-beam which is secured to said wall element and has upstanding edges along the sides of an associated said wall element to support said sides upon inflation of the wall element.

* * * * *